US005640827A

United States Patent [19]

Van Someren et al.

[11] Patent Number: 5,640,827

[45] Date of Patent: Jun. 24, 1997

[54] DEVICE AND METHOD FOR PROVIDING A BARRIER TO UNWANTED PENETRATION OF FINISHING MATERIALS

[76] Inventors: Robert A. Van Someren; Diana M. Van Someren, both of 2544 N. 81; Patrick S. Yoder, 6119 W. Wisconsin Ave., all of Wauwatosa, Wis. 53213

[21] Appl. No.: 594,135

[22] Filed: Jan. 31, 1996

[51] Int. Cl.[6] ..... B05D 5/10

[52] U.S. Cl. ..... 52/750; 427/208.6; 427/208.4; 427/143; 427/286; 427/288; 428/343

[58] Field of Search ..... 52/750; 434/84, 434/87; 248/129, 345.1; 427/143, 154, 155, 208.4, 208.6, 285, 286, 288, 179; 428/343; 156/212, 213, 219, 244.27

[56] References Cited

U.S. PATENT DOCUMENTS

| | | | |
|---|---|---|---|
| 2,186,124 | 1/1940 | Rash | 427/208.6 X |
| 3,930,069 | 12/1975 | Stephens | 427/285 X |
| 4,201,799 | 5/1980 | Stephens | 427/285 X |
| 4,696,848 | 9/1987 | Jones et al. | 427/208.4 X |
| 5,038,898 | 8/1991 | Jonkowski | 182/129 |
| 5,464,692 | 11/1995 | Huber | 427/208.4 X |
| 5,487,915 | 1/1996 | Russ et al. | 427/208.4 X |

FOREIGN PATENT DOCUMENTS

| | | | |
|---|---|---|---|
| 3248054 | 7/1983 | Germany | 427/154 |

*Primary Examiner*—Carl Friedman
*Assistant Examiner*—W. Glenn Edwards

[57] ABSTRACT

A barrier device for preventing unwanted penetration of finishing materials from one surface onto another. The barrier device is particularly useful to protect one surface from unwanted penetration of paint or varnish while the adjacent surface is coated. The barrier device includes a flexible sheet having a substantial width and a narrower strip capable of retaining an impression. The strip and sheet are applied to a textured surface by pressing the strip onto the surface with sufficient force such that the strip material retains an impression of the texture.

20 Claims, 2 Drawing Sheets

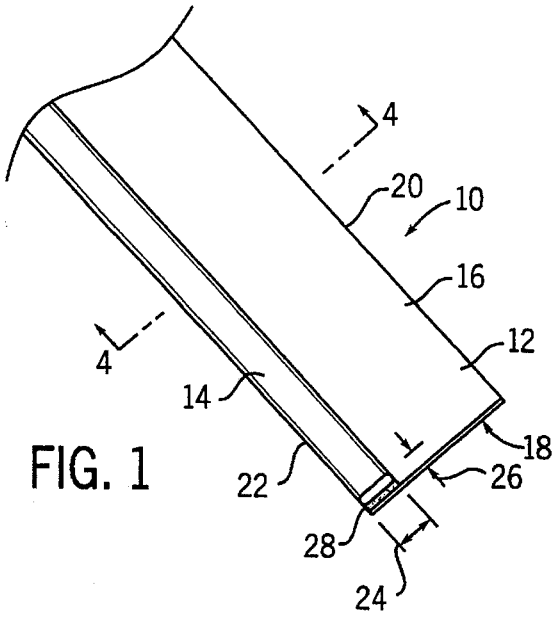
FIG. 1
FIG. 2
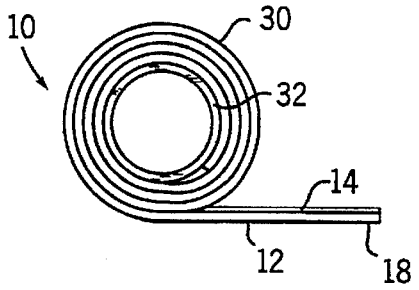
FIG. 3
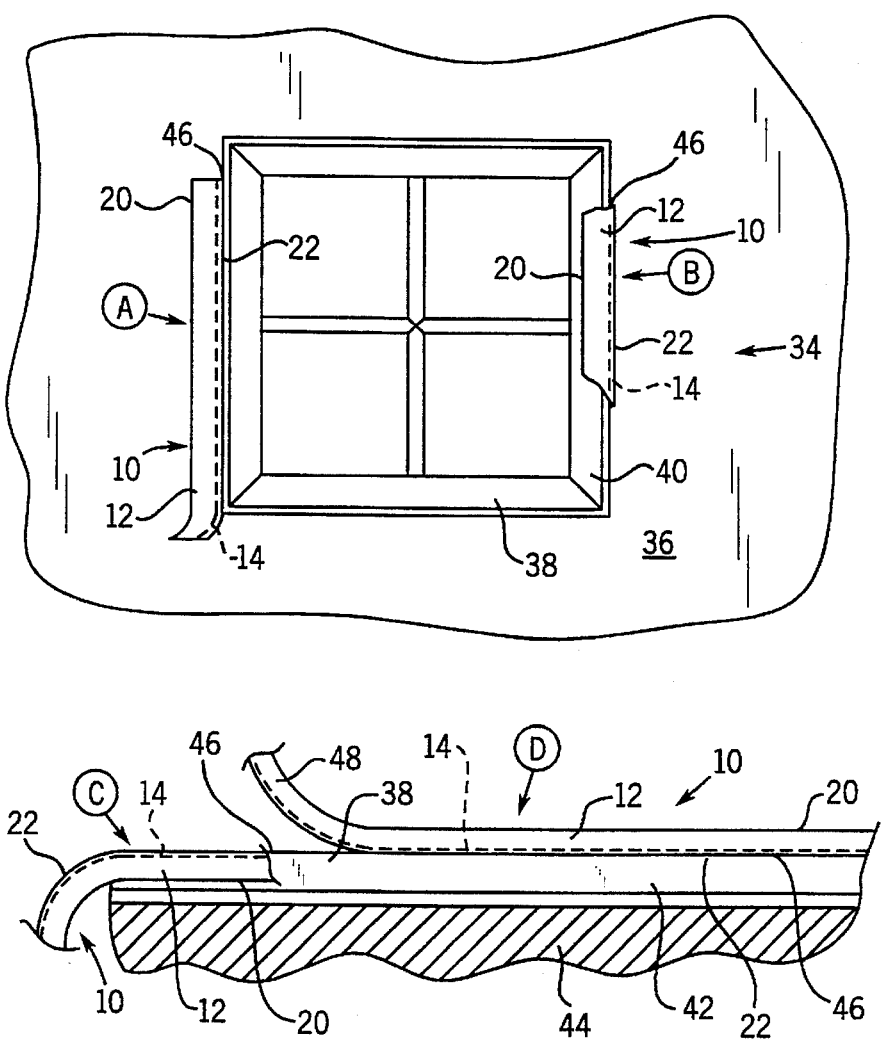

DEVICE AND METHOD FOR PROVIDING A BARRIER TO UNWANTED PENETRATION OF FINISHING MATERIALS

FIELD OF THE INVENTION

The present invention relates generally to a device and method for providing a barrier to unwanted flow or penetration of finishing materials and particularly to a flexible device that may be applied along an edge of a surface being finished by, for instance paint or varnish, to prevent unwanted flow onto the adjacent surface.

BACKGROUND OF THE INVENTION

Surfaces, such as wall surfaces, often are covered with a finishing material, such as paint, stain, or varnish. Often, there are adjacent surfaces onto which the finishing material is not applied. For example, in a typical interior room, the wall surfaces are painted while the trim, such as moldings and window frames, are stained, varnished, or painted a different color. When the wall surface or trim surface is refinished, the adjacent surface must be covered to prevent unwanted penetration or seepage thereon.

Finishing material that seeps or splashes onto the adjacent surface must be removed. This can be time consuming at best, and it can also potentially cause permanent discoloration or damage. Similar problems are encountered when finishing exterior surfaces of a building or any two adjacent surfaces in which each surface is covered with a different finishing material.

One of the primary problem areas for unwanted penetration is along the boundary between the two differently finished surfaces. This problem is typified by the application of paint along stained and vanished trim pieces. Conventional paint brushes and paint rollers make it difficult for the user to apply the paint proximate the trim without having the paint splash or seep onto the trim.

Masking tape often is applied along the boundary to prevent this unwanted flow of paint onto the trim molding. Alternatively, masking tape is applied to the wall surface to prevent unwanted flow of paint or vanish from the trim molding onto the wall surface during finishing of the trim. However, masking tape is often unable to provide a sufficient seal along the boundary line between adjacent surfaces. Even with the slightest texture, such as old paint, marring, or nicks, the masking tape fails to adequately fill voids caused by the textured surface. Thus, the finishing material seeps under the masking tape onto the adjacent surface.

It would be advantageous to provide a barrier material that could be precisely applied along the boundary line between adjacent surfaces to prevent unwanted flow of finishing material from one surface to the other even when the surfaces have a textured quality.

SUMMARY OF THE INVENTION

The present invention features a device and method for preventing the unwanted overflow of certain materials during application of such materials on a first surface adjacent a second surface to which the materials are not applied. The device includes a flexible sheet having an outer material deflection surface and an inner surface. The outer material deflection surface and the inner surface are both bounded by a distal edge and a proximal edge.

A strip of impressible material is affixed to the inner surface and disposed along the proximal edge. The strip has a width extending a portion of the distance between the proximal edge and the distal edge. Additionally, the strip has a thickness measured generally perpendicularly to the inner surface.

The flexible sheet and strip may be pressed against the first surface along a borderline with the second surface to prevent unwanted flow of finishing material from the second surface onto the first surface. The strip is impressible and able to retain impressions therein. Thus, when the strip is pressed against the first surface with sufficient force, any voids, defects, interstices, cracks, or other textured surfaces are substantially filled by the strip to prevent unwanted penetration of finishing material from the second surface onto the first surface.

According to additional aspects of the invention, a method is provided for facilitating application of a material, such as paint or varnish, to one surface without permitting overflow of material onto an adjacent surface. The method includes the steps of forming a strip of impressible material capable of maintaining impressions therein, and attaching the strip to an inner surface of a flexible sheet. The strip preferably is attached proximate a longitudinal edge of the flexible sheet. According to other aspects to the inventive method, the flexible sheet is oriented so the strip is disposed between the adjacent surface and the flexible sheet. The strip is then pressed against the adjacent surface until it is impressed and any voids in the surface are substantially filled.

BRIEF DESCRIPTION OF THE DRAWINGS

The invention will hereafter be described with reference to the accompanying drawings, wherein like reference numerals denote like elements, and:

FIG. 1 is a perspective view of a device for preventing the unwanted penetration of certain materials onto a surface, according to a preferred form of the present invention;

FIG. 2 is a side view of the device of FIG. 1 wrapped about an inner core;

FIG. 3 is a front view of the overall system of the invention in which the barrier device is applied along the boundary line of two adjacent surfaces;

DETAILED DESCRIPTION OF THE PREFERRED EMBODIMENT

Figure 4:
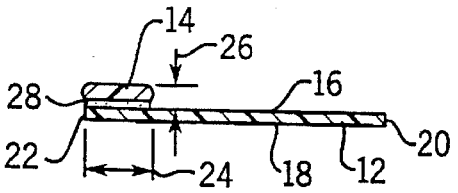
FIG. 4 is a cross-sectional view taken along line 4—4 of FIG. 1.

Referring generally to FIG. 1, a barrier device 10 for preventing unwanted flow or penetration of certain finishing materials is illustrated according to a preferred embodiment of the invention. Barrier device 10 includes a flexible sheet 12 and a strip of material 14.

Flexible sheet 12 includes an inner surface 16 and an outer material deflection surface 18 generally on the opposite side of flexible sheet 12 from inner surface 16. Both inner surface 16 and outer material deflection surface 18 are bounded by a distal edge 20 and a proximal edge 22. Preferably, distal edge 20 and proximal edge 22 extend in the longitudinal direction of flexible sheet 12, i.e., along the length of flexible sheet 12 as best illustrated in FIG. 1.

Strip 14 is attached to inner surface 16, and is disposed preferably along proximal edge 22. Strip 14 has a width shown by reference numeral 24 and a thickness shown by reference numeral 26. Thickness 26 is measured in a direction generally perpendicular to inner surface 16. Width 24 could be as great as the width of flexible sheet 12, but it typically only extends a portion of the distance between proximal edge 22 and distal edge 20. In the most preferred embodiment, the width of strip 14 is less than one quarter the width of flexible sheet 12 to save material and cost of production.

Strip 14 may be made from a variety of materials known to those of ordinary skill in the art. Exemplary materials are clay, various silicone caulking materials, and preferably silicone putty, such as exercise putty, e.g., ExerGrip™ distributed by Bollinger Industries of Irving, Tex. The properties of the material used to make strip 14 are such that strip 14 may be impressed by a protuberance or protuberances and retain those impressions. Thus, when strip 14 is pressed with sufficient force against a surface having a texture, strip 14 will reshape itself according to the textured surface and thus fill any cracks, voids, openings, undulations, crevices, interstices, or voids that are part of the textured surface. The impressions created in strip 14 by the textured surface are retained in the material so strip 14 remains in place along the desired surface and substantially seal the textured surface from any penetration of finishing materials, such as paint, applied adjacent barrier device 10.

Strip 14 can be attached to flexible sheet 12 in a variety of ways, but preferably it is adhered to flexible sheet 12 by an adhesive layer 28. Adhesive layer 28 should have sufficient bonding strength to maintain the attachment of strip 14 to flexible sheet 12 when a finishing operation is completed and flexible sheet 12 is moved or pulled away from the surface on which barrier device 10 is applied. This will be more fully described with reference to FIG. 3. Where suitable materials are used for strip 14, these may be adhered directly to sheet 12 without use of a separate adhesive, as described below.

Flexible sheet 12 also can be made from a variety of materials. For instance, materials such as paper, cloth, and plastic could readily be used. However, the material should be sufficiently flexible to permit use of barrier device 10 along curved or nonlinear surfaces. Additionally, flexible sheet 12 should not be made from a material so porous as to permit easy penetration of the finishing materials therethrough, unless strip 14 is wide enough to sufficiently repel such materials should they penetrate through sheet 12. For certain applications, it may be advantageous to provide a relatively cheap base substrate, such as paper, while providing outer material deflection surface 18 with a liquid impervious coating, such as polypropylene.

Barrier device 10 can be packaged in individual strips or by folding flexible sheet 12 back and forth on itself generally in the longitudinal direction. It is often easiest, though, to roll or wrap flexible sheet 12 and strip 14 into a roll 30 as illustrated in FIG. 2. To prevent creasing flexible sheet 12 or strip 14, it is sometimes desirable to wrap barrier device 10 about a central core 32, such as the cylindrical core illustrated in FIG. 2.

In FIG. 3, the entire system and method for using barrier device 10 in the application of materials, such as paint or varnish, to designated surfaces is disclosed. The entire system for preventing the unwanted penetration of finish materials from one surface to another is designated generally by the reference numeral 34. System 34 represents a typical environment in which barrier device 10 can be used, and includes a first surface, such as wall surface 36, and a second surface or surfaces, such as trim surfaces 38. Trim surfaces 38 are generally the exterior surfaces on various trim elements, such as window frame 40 or molding 42. Molding 42 may be found in various positions along wall surface 36 but is illustrated adjacent a floor 44.

In FIG. 3, barrier device 10 is illustrated as being applied along the various surfaces at four different locations represented as locations A, B, C, and D, respectively. Only portions of barrier device 10 are illustrated to facilitate description of system 34 and the method of applying finishing materials to adjacent surfaces. If for example, trim surfaces 38 are to be painted without penetration of the paint onto wall surface 36, barrier devices 10 would be applied as illustrated at positions A and D. In other words, proximal edge 22 and strip 14 are applied along the boundary 46 between adjacent surfaces, e.g., between wall surface 36 and the various trim surfaces 38. In this particular application, flexible sheet 12 is oriented to extend away from the corresponding trim surface 38 being painted. Thus, the entire trim surface can be painted, and strip 14 along with flexible sheet 12 cooperate to prevent the penetration of paint onto wall surface 36 via either spotting along boundary 46 or seeping between flexible sheet 12 and the wall surface.

In a different or subsequent application, the user may wish to paint or otherwise finish wall surface 36 while preventing any penetration of finishing materials onto the various trim surfaces 38. The barrier device 10 would then be applied as illustrated at locations B and C of FIG. 3. At those locations, barrier device 10 is properly oriented so strip 14 is disposed between flexible sheet 12 and the surface to be covered, in this case trim surface 38.

The proximal edge 22 and strip 14 are then aligned with boundary 46 between adjacent wall and trim surfaces, and strip 14 is pressed against the appropriate trim surfaces 38. The barrier device 10 is thus oriented so proximal edge 22 and strip 14 are disposed along the corresponding boundary 46 while flexible sheet 12 extends at least part way over the corresponding trim surface 38, as illustrated at locations B and C of FIG. 3.

In applying barrier device 10 to a given surface, strip 14 must be pressed with sufficient force to ensure that its impressible material conforms to whatever texture the surface may have. For example, in the application described with reference to FIG. 3, strip 14 must be pressed against wall surface 36 at locations A and D with enough force to conform with the often slightly textured surface created by paint or, on the other hand, the more exaggerated texture of a spackled surface. Similarly, when strip 14 is pressed against trim surfaces as illustrated at locations B and C, there must be sufficient force of application to cause strip 14 to substantially fill any nicks, mars, cuts, cracks, or natural texture of the molding.

After application of barrier device 10 along a desired boundary 46, the exposed surface along boundary 46 may be coated with an appropriate finishing material. Following passage of sufficient time to permit drying or stabilization of the finishing material, barrier device 10 is simply moved away from boundary 46 and the surface to which it is applied. This may be accomplished by grasping an end 48, as best illustrated at location D in FIG. 3, and pulling end 48 until barrier device 10 is completely removed. For some applications, barrier device 10 can be reused at a new location.

Figure 5:
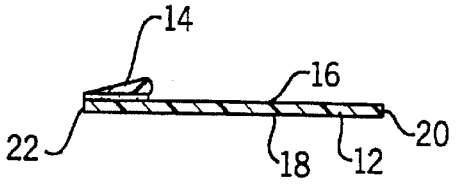
FIG. 5 is a cross-sectional view similar to that of FIG. 4, but showing an alternate embodiment.

Barrier device 10 can be designed in a variety of ways depending on the particular application. For example, the cross-sectional shape of strip 14 can be adjusted for various applications as illustrated best by the cross-sectional views of FIGS. 4–6. FIG. 4 is a cross-sectional view of the exemplary embodiment illustrated in FIG. 1. In this embodiment, strip 14 has a generally uniform thickness 26. However, in the alternate embodiment illustrated in FIG. 5, strip 14 has a minimum thickness adjacent proximal edge 22 and a maximum thickness at the opposite end of its cross-section. In other words, strip 14 has a generally wedge-shaped cross section in which the narrow or pointed end of the wedge is closest proximal edge 22.

Figure 6:
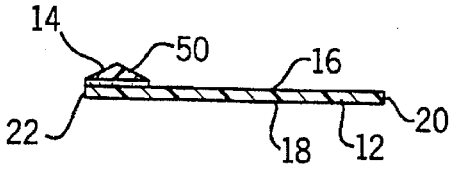
FIG. 6 is a cross-sectional view similar to that of FIG. 4, but showing another alternate embodiment.

Another alternate embodiment is illustrated in FIG. 6. In this embodiment, strip 14 has a maximum thickness at a central region 50. The strip 14 becomes thinner across its width moving away from central region 50 as illustrated.

A wide variety of strip shapes and thicknesses may be used, depending on the particular application. In a typical situation in which barrier device 10 is applied along a normal painted surface, it is desirable to use a strip 14 having a maximum thickness region of at least 1/32 of an inch, and preferably approximately 1/32 of an inch. In other applications, such as painting along older, marred moldings, it may be beneficial to have a somewhat thicker strip of at least 1/16 of an inch, and preferably approximately 1/16 of an inch. However, if the surface has a greater texture, such as the texture of a spackled wall, it may be necessary to use a still thicker strip 14 having a thickness of at least 1/8 inch and preferably approximately 1/8 inch.

Figure 7:
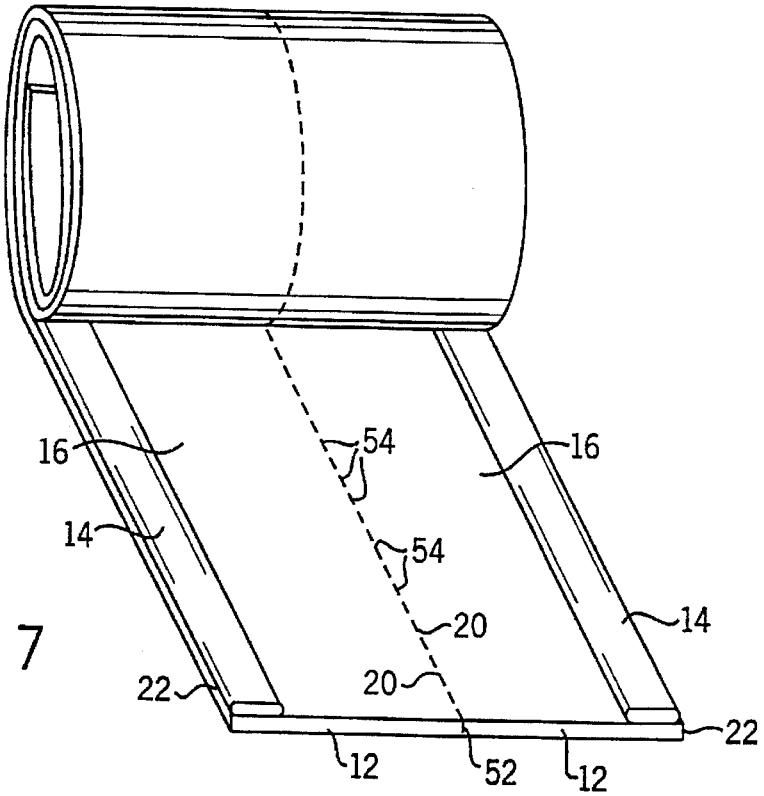
FIG. 7 is an alternate embodiment of the invention in which a pair of strips is attached to corresponding sheets that are connected along a weakened area.

An alternate embodiment of barrier device 10 is illustrated in FIG. 7 in which two or more barrier devices 10 are combined in a single unit. In the illustrated embodiment, a pair of flexible sheets 12 are connected along a weakened line 52. Weakened line 52 may be formed, for example, by a series of perforations 54.

In the exemplary embodiment of FIG. 7, each sheet 12 is joined along its distal edge 20, and strips 14 are attached to the inner surface 16 along the proximal edge 22 of each flexible sheet 12, in this case the outer edges as illustrated. As shown, the combined flexible sheets 12 and strips 14 may be wrapped into a roll for ease of use and transport.

It will be understood that the foregoing description is of a preferred embodiment of this invention and that the invention is not limited to the specific forms shown. For example, the barrier device may be made in various shapes and sizes, it may be made in individual sheets, strips, or rolls, and it may be constructed from a wide variety of materials. Additionally, the thickness, width, and shape of the impressible strip may be changed and made for various applications. Furthermore, when made in strips, the various strips may be joined along weakened lines and thus packaged together in, for instance, rolls or sheets. These and other modifications may be made in the design and arrangement of the elements without departing from the scope of the invention as expressed in the appended claims.

What is claimed is:

1. A device for preventing the unwanted overflow of certain materials onto a textured permanent surface during application of such materials along the textured permanent surface, comprising:

a flexible sheet including an outer material deflection surface and an inner surface, the outer material deflection surface and the inner surface both being bounded by a distal edge and a proximal edge; and a strip of impressible material affixed to the inner surface and disposed along the proximal edge, the strip, being moldable, having a width extending a portion of the distance between the proximal edge and the distal edge, the strip further having a maximum thickness extending away from the inner surface, the maximum thickness being sufficient to permit formation of impressions that correspond to the textured permanent surface when the strip is pressed against the textured permanent surface, and wherein the impressions are retained in the strip after it is pressed against the textured permanent surface.

2. The device as recited in claim 1, further comprising a layer of adhesive disposed to adhere the strip to the flexible sheet.

3. The device as recited in claim 2, wherein the flexible sheet includes a paper material.

4. The device as recited in claim 2, wherein the flexible sheet includes a plastic material.

5. The device as recited in claim 1, wherein the strip has a cross-section in the shape of a wedge having a narrow end and a thick end, the narrow end being disposed closer to the proximal edge than the thick end.

6. The device as recited in claim 1, wherein the strip has a maximum thickness at a central region.

7. The device as recited in claim 1, wherein the strip has a maximum thickness region that is at least 1/32 of an inch.

8. The device as recited in claim 1, wherein the strip has a maximum thickness region of a least 1/16 of an inch.

9. The device as recited in claim 1, wherein the strip has a maximum thickness region of at least 1/8 of an inch.

10. The device as recited in claim 1, further comprising:

a second flexible sheet connected to one of the distal edge or proximal edge and including a second outer material deflection surface and a second inner surface; and a second strip of impressible material.

11. The device as recited in claim 10, wherein the second flexible sheet is connected to the flexible sheet along a weakened line.

12. The device as recited in claim 11, wherein the weakened line comprises a plurality of perforations.

13. A system for preventing the unwanted overflow of certain materials onto a textured surface during application of such materials along the textured surface, comprising:

a wall surface to which the materials are to be applied;

a trim panel mounted along the wall surface, the trim panel having the textured surface;

a flexible sheet including an outer material deflection surface and an inner surface, the outer material deflection surface and the inner surface both being bounded by a distal edge and a proximal edge; and a strip of impressible material affixed to the inner surface and disposed along the proximal edge, the strip, being moldable, having a width extending a portion of the distance between the proximal edge and the distal edge, the strip further having a maximum thickness extending away from the inner surface, the maximum thickness being sufficient to permit formation of impressions that correspond to the textured surface when the strip is pressed against the textured surface, and wherein the impressions are retained in the strip after it is pressed against the textured permanent surface.

14. The system as recited in claim 13, further comprising a layer of adhesive disposed to adhere the strip to the flexible sheet.

15. The system as recited in claim 14, wherein the flexible sheet includes a paper material.

16. A method for facilitating application of a material such as paint or varnish to one surface without permitting overflow of the material onto an adjacent surface having a texture, comprising the steps of:

forming a strip of moldable impressible material capable of maintaining impressions therein when pressed against the adjacent surface, wherein the step of forming includes the step of providing the strip of moldable impressible material with a maximum thickness sufficient to permit the strip to conform to the texture; and affixing the strip, by an adhesive layer, to an inner surface of a flexible sheet proximate a longitudinal edge of the flexible sheet.

17. The method as recited in claim 16, further comprising the step of shaping the strip so it has a generally wedge shaped cross-section.

18. The method as recited in claim 16, wherein the step of forming includes providing the strip with a thickness measured generally perpendicularly to the inner surface, the thickness being at least approximately 1/32 of an inch.

19. The method as recited in claim 16, further comprising the steps of:

orienting the flexible sheet so the strip is disposed between the adjacent surface and the flexible sheet; and pressing the strip against the adjacent surface until the strip is impressed and any voids in the surface are substantially filled.

20. The method as recited in claim 19, further comprising the steps of:

applying the material over the one surface along the adjacent surface;

waiting a period of time; and moving the strip and flexible sheet away from the adjacent surface.

* * * * *